US005827611A

United States Patent [19]

Forbes

[11] Patent Number: 5,827,611

[45] Date of Patent: Oct. 27, 1998

[54] MULTILAYERED THERMOPLASTIC ARTICLE WITH SPECIAL PROPERTIES

[75] Inventor: Charles E. Forbes, Bridgewater, N.J.

[73] Assignee: Hoechst Celanese Corp, Somerville, N.J.

[21] Appl. No.: 814,650

[22] Filed: Mar. 10, 1997

[51] Int. Cl.[6] ..... D02G 3/00

[52] U.S. Cl. ..... 428/375; 428/374

[58] Field of Search ..... 428/370, 373, 428/374, 375; 385/128

[56] References Cited

U.S. PATENT DOCUMENTS

| | | | |
|---|---|---|---|
| 4,542,957 | 9/1985 | Ishiwari et al. | 350/96.34 |
| 4,566,755 | 1/1986 | Ohmori | 350/96.34 |
| 4,568,146 | 2/1986 | Ueba et al. | 350/96.34 |
| 4,720,166 | 1/1988 | Ohmori et al. | 350/96.34 |
| 5,198,925 | 3/1993 | Heumuller et al. | 359/356 |
| 5,319,131 | 6/1994 | Heumuller et al. | 560/219 |
| 5,541,247 | 7/1996 | Koike | 524/285 |
| 5,593,621 | 1/1997 | Koike et al. | 264/1.29 |
| 5,624,754 | 4/1997 | Choe et al. | 428/373 |
| 5,654,097 | 8/1997 | Choe et al. | 428/373 |

FOREIGN PATENT DOCUMENTS

| | | |
|---|---|---|
| 0128517 | 12/1984 | European Pat. Off. . |
| 0128516 | 12/1989 | European Pat. Off. . |

*Primary Examiner*—Newton Edwards
*Attorney, Agent, or Firm*—Hans-Peter Hoffmann

[57] ABSTRACT

Thermoplastic multicomponent articles are shown wherein the components comprise a polymer matrix wherein one component contains at least one uniformly distributed substantially unreactive low molecular weight, guest molecule or compound which imparts different properties to the component.

12 Claims, 4 Drawing Sheets

MULTILAYERED THERMOPLASTIC ARTICLE WITH SPECIAL PROPERTIES

FIELD OF THE INVENTION

This invention relates to thermoplastic multicomponent articles, in particular, articles wherein at least one thermoplastic component matrix is modified by an unpolymerized guest molecule, and a continuous manufacturing process therefor.

BACKGROUND OF THE INVENTION

In the past, bicomponent fibers or filament combining a core component and cladding component have been found useful in the fabrication of nonwoven products. The orientation of the core and cladding of bicomponent fibers may be concentric, ellipsoid, or off center (eccentric). The development of technology for thermoplastic multicomponent fibers or filaments has opened the path to new applications.

Multicomponent thermoplastic fibers or heterofilaments have desirable properties, such as small diameter, great length, flexibility, and when used on optical fibers, high signal transparency and controlled signal transmission. In general, multicomponent thermoplastic layers or fibers are constructed of an inner layer or core component surrounded or enveloped by an outer layer or cladding component. The best known use of multicomponent layers or fibers is in the field of fiber optics. The most basic form of multicomponent fibers, namely the bicomponent optical fibers, are cylindrical dielectric waveguides made of low attenuating materials such as, e.g., glass or plastic.

The bicomponent fiber usually contains an inner core component surrounded by an outer cladding of slightly lower refractive index and is especially suitable as a light waveguide or transmitter. The bicomponent optical fibers are usually of the step-index (SI) type. The refractive index of SI fibers is different in the core from cladding component. The refractive index changes abruptly in a single step at the core-cladding boundary. The successful guidance of a light signal pulse through the length of a step-index waveguide requires that the light rays are totally internally reflected. Total reflection occurs when a light ray enters the core-cladding boundary at an angle greater than a so-called critical angle such that the light ray is reflected internally and no refraction and outward scatter occurs. The critical angle is proportional to $\sin^{-1}(n_2/n_1)$ where $n_1$ is the core refractive index, $n_2$ is the refractive index of the cladding, and $n_2<n_1$. When rays are inclined at a greater than the critical angle to the fiber axis, the intensity or power is diminished by signal loss into the cladding at each reflection, thus resulting in incomplete guidance or transmission.

Since light pulse signals are transmitted through an optical fiber at a speed which is inversely proportional to the refractive index of the fiber material, the light signals are attenuated and decrease in intensity as the refracted light phase is displaced along the fiber center axis toward the fiber cladding or periphery. Light waves from a short pulse of light will travel through the core of a step-index fiber in different paths, such that the received wave signals become dispersed. Thus, the travel times of individual waves change and cause the initially short or narrow signal pulses to spread.

The problem of so-called modal dispersion in optical fibers may be overcome in several ways. One method is to construct a step-index fiber (SI) where the core diameter is so small that only a single mode can pass through the fiber.

Another method utilizes the graded refractive index (GRIN) fiber. The GRIN fiber affords a parabolic change of refractive index from a maximum value at the center axis and a minimum value at the core perimeter or core-cladding boundary. The refractive index gradient causes the transmitted light ray to be propagated in spirals along the length of the fiber core cylinder thereby achieving clear signal transmission. Rays or wavefronts transmitted through GRIN fibers follow curved trajectories with paths shorter than those in the step-index fiber. For example, the axial ray travels the shortest distance at the smallest phase velocity due to the largest refractive index ($n_1$) while obliquely angled rays travel longer distances at higher phase velocities due to the smaller refractive index ($n_2<n_1$). As a result, the delay times are equalized, and the difference between the group velocities of the modes is much diminished in comparison to the multi-modal step-index fiber. Fibers with small core diameter transmit only a single mode, while fibers with large core diameters are suitable to guide so-called multimode fibers signals.

Recent advances in the fabrication of fibers from thermoplastic optical materials permit light to be guided through 1 km of fiber with a signal loss as low as about 10 dB. The modal dispersion which is likely to be encountered with light propagation in multimode fibers can be avoided or minimized with the use of a GRIN type fiber whose refractive index is at its maximum value at the core center and at its minimum value at the core-cladding interface.

The preparation of a thermoplastic GRIN fiber involves typically a discontinuous, two-step procedure. For example, a polymethylmethacrylate (PMMA) tube is filled with an admixture of methylmethacrylate monomer, a small unreactive guest molecule such as, bromobenzene, a catalyst, and a chain transfer agent. The cladding polymer and the core monomer content are mutually compatible such that, upon loading, the monomer mixture will solubilize the polymer. The monomer mixture penetrates well into the PMMA wall of the tube forming a gel-like consistency before the core is polymerized. In fact, the polymerization proceeds preferentially in the gel phase that is formed by the diffusion of MMA monomer into the inner PMMA wall at the core/clad interface. During the polymerization, the additive bromobenzene of the monomer mixture diffuses towar the center axis. As a consequence, the bromobenzene concentration increases gradually and radially from the polymerized periphery toward the still liquid center axis. The GRIN effect in the core is due to the gradual change in concentration of the highly refractive bromobenzene during the polymerization. In order to obtain a fiber or filament of suitably narrow dimensions, the GRIN preform is drawn out in a drawing tower under heat while the characteristic cross-sectional GRIN profile is effectively retained. These prior art GRIN fibers are monocomponent fibers and do not have a separate cladding layer.

The thermoplastic optical fiber product is usually formed by heat-drawing or heat-stretching from a cylindrical preform of relatively short and thick dimensions wherein the structural components such as core and cladding and their mutual proportions and distributions are set. The much narrower transverse dimensions of the final fiber product which is drawn from such a preform usually retains a characteristic graduated core guest molecule distribution such that, the graded refractive index is similar and proportional to that of the starting preform.

The present invention provides a new method for continuous production of a heterocomponent fiber for long distance signal transmission which overcomes the shortcomings of limited length and consequent frequent splicings.

The present invention provides thermoplastic fibers, doped by appropriate guest molecules either in the core or clad or sheath component so as to modify the properties of the doped component.

SUMMARY OF THE INVENTION

The present invention provides a thermoplastic bicomponent article wherein an unreacted small guest molecule is present within the homopolymeric matrix of one of the components. The guest molecule does not copolymerize with the matrix monomer. While the doping guest compound must be soluble in the polymer matrix, it must not react with the monomers of the matrix prior to their polymerization. The guest molecule located or trapped within the host polymer matrix imparts its own different properties to or changes one or more of the properties of the fiber component.

A thermoplastic article may be a bicomponent fiber comprising a core component and at least one cladding formed of a polymer matrix wherein a substantially unreactive low molecular weight "guest" compound is distributed throughout one of the components. The doped matrix can exhibit, for example, optical, electrical and chemical properties, such as color, tackiness, fire retardancy, antistatic properties, etc.

A fiber according to this invention may exhibit a concentrically aligned layer surrounding a cylindrical or ellipsoid core element with an outer sheath layer or clad component. The outer components may completely surround the core like a sheath or only partially cover the core surface so as to form an incomplete layer.

The unreactive low molecular weight guest compound may be transparent to electromagnetic radiation and contribute to the conductive properties of the fiber.

A specific embodiment of the invention provides a bicomponent fiber or filament wherein the core component comprises a homopolymer such as polystyrene and the cladding component comprises the same homopolymer as the core component and in addition contains about 1–20% by weight of a small low molecular weight guest compound so as to suitably modify, e.g., a physical property of the cladding or outer layer.

A continuous process for manufacturing a step-index bicomponent optical fiber or filament of the invention is provided, which comprises, spinning a core-cladding combination of the same basic thermoplastic material with the added presence of a small guest molecule in the cladding suitable for modifying the cladding matrix compared to the core matrix.

The present invention further provides a process for the fabrication of multi-component transparent shaped thermoplastic optical articles comprising the steps of forming a thermoplastic sheath or cladding portion in a concentric uniform orientation around a compatible center core portion having a different refractive index and polymerizing the same thermoplastic material such that a change is effected at the core-clad boundary. Alternatively, the process provides for uniformly admixing an unreactive low molecular weight molecule with a thermoplastic molding compound in order to produce a core matrix component having a different chemical or physical property than the matrix of the cladding component.

A continuous fabrication method for multicomponent thermoplastic fibers according to this invention is provided. In particular, the present invention is directed to the production of a fiber wherein a thermoplastic polymer cladding or tube is continuously extruded and filled with a polymerizable fluid core admixture containing an unreactive small guest molecule. As the core component is gradually polymerized from the cladding boundary radially to the core axis the extruded cladding is simultaneously heat softened and heat-stretched to its fully drawn dimension. The continuous production process of a heterocomponent polymeric fiber having a GRIN core component and a tube wall component, comprises the following steps:

(a) packing a hollow fiber body or tube comprising a polymeric wall matrix component with a core component admixture comprising a monomer, a catalyst, a chain transfer agent and a substantially unreactive soluble low molecular weight additive, the monomer being capable of penetrating and solubilizing the polymeric cladding/wall matrix;

(b) progressively polymerizing the core admixture from the periphery toward the center axis of the core; and (c) heating and stretching or drawing the heterocomponent fiber out to the desired proportions of length, thickness or diameter.

In a specific embodiment of this invention, the tube cladding is also heat-stretched continuously or intermittently to prevent bubble or vacuum void formation during the polymerization of the core (step b).

Pursuant to this continuous fabrication, the nonreactive low molecular weight additive is distributed in the core in a concentration gradient which increases radially toward the core center axis.

In the final product, the central core component exhibits a graduated refractive index different from that of the outer cladding/wall polymer. It is preferred that the GRIN core exhibit a refractive index at least about 0.001 units higher than the clad/wall polymer.

A more preferred embodiment of the present invention is directed to the process wherein the fiber is optically transparent and the guest molecule has a refractive index at least about 0.005 units or more preferably only about 0.01 units, higher than the cladding polymer.

In other embodiments the small guest molecule can attribute different properties to the core component such as a graduated light filtering color or tint difference.

A preferred embodiment according to the present invention is directed to the continuous production of a thermoplastic polymer article, such as a bicomponent fiber comprising the following steps: (a) extruding and curing a hollow tube or cylindrical cladding composed of a thermoplastic heat deformable polymer; (b) filling the tube or the hollow cylindrical cladding with a core admixture of at least one monomer, a non-reactive low molecular weight additive, a catalyst, and a chain transfer agent; and in a continuous operation, applying external reaction energy (heat or light) to the core monomer admixture for polymerization; (c) simultaneously heating and drawing the bicomponent article to a suitable dimension. As a consequence the polymerization of the core upon initiation from the outside energy source proceeds progressively from the clad/wall toward the center of the core component of the fiber thereby gradually displacing and increasing the presence of the additive from the perimeter to the axis of the core.

The preferred vertical extrusion system of the invention provides a pressure or piston movement for forming a hollow cylinder or tube cladding from prepolymerized basic polymeric matrix. The hollow tube cladding is simultaneously filled with the core mixture as described and exposed to a rotating external energy source. The tube cladding portion is heat-stretched intermittently, the pulling force or tension and heating energy or temperature being continuously and electronically controlled and measured by an appropriately calibrated monitor.

Other embodiments of this invention concern a multicomponent or bicomponent fiber comprising a jacket sheath or coating enshrouding the core which can be GRIN or non-GRIN and wherein the cladding has additional properties such as color, adhesiveness, low friction or slidability, identifying or codifying pattern, or chemical corrosion protection.

An optional process step according to the invention provides for additional stabilization of the guest molecules by further cross-linking radiation or other modification of the polymer chains.

The process may be used to manufacture a variety of shaped multicomponent articles. Preforms from multicomponent thermoplastic molding as produced by the inventive process may be further drawn out into the final fiber dimension by application of heat according to methods well known to those of ordinary skill in the art. Fibers with a final core of about 0.1 to about 0.6 mm in diameter are preferred.

The present invention also provides transparent encladded fibers or filaments where the clad polymer contains small guest molecules affording useful properties in the optical signal transmission field. In particular, the clad may be modified to obtain desirable signal protecting or controlling properties.

Other aspects of the invention concern fibers which have a modified clad layer of the filament imparting tacky or adhesive properties to the filament aiding in the bundling of a plurality of filaments.

Another embodiment of the invention provides a second coating sheath or cladding layer of a filament affording identifying color and other coding properties.

An embodiment of the invention provides features or combination of features for filament cladding containing guest molecules imparting antioxidant, antistatic, shielding or lubricant qualities to the cladding.

DETAILED DESCRIPTION OF THE INVENTION

Figure 1:
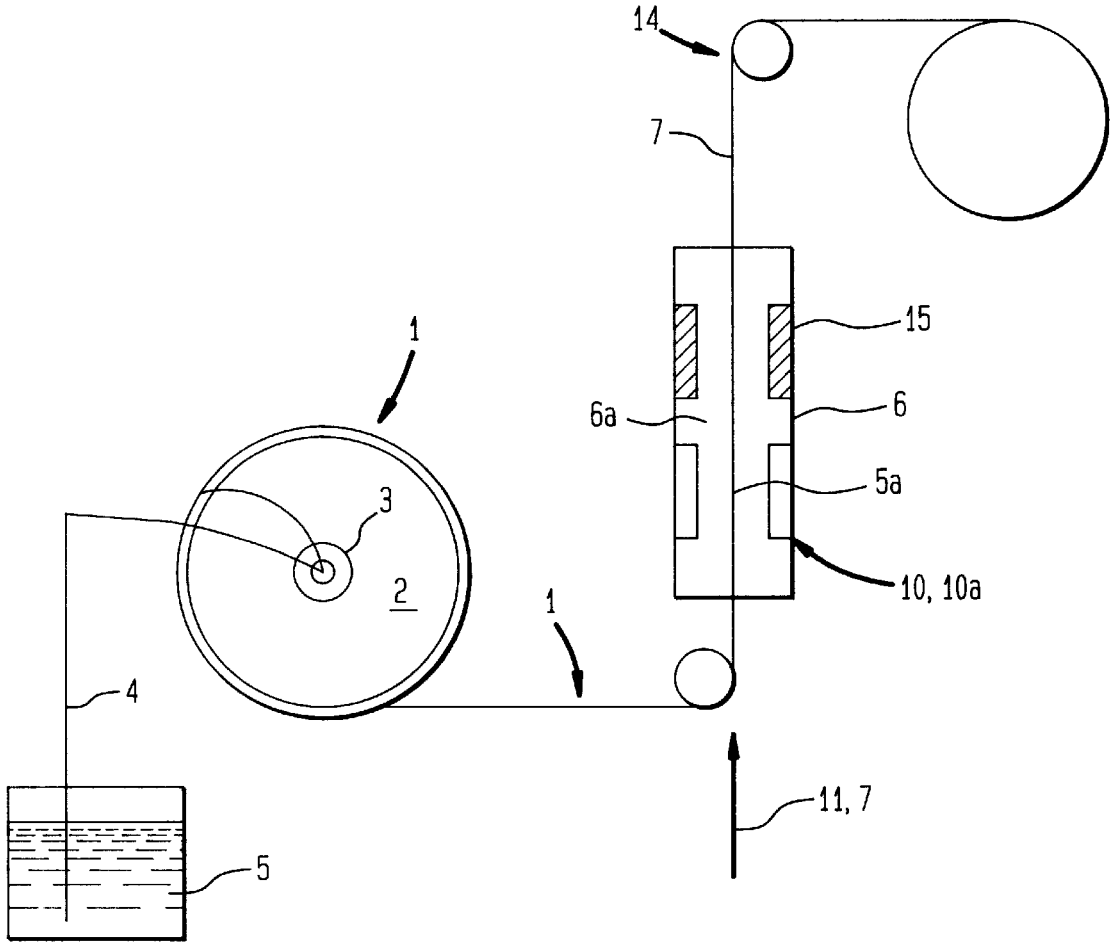
FIG. 1 illustrates a layout for the continuous production of GRIN fiber from preformed tubing.

Thermoplastic fiber with optical or nonoptical properties are usually produced from amorphous plastics like poly (methylmethacrylate) (PMMA), polystyrene (PS) or polycarbonate (PC). The materials used have to be highly purified in order to assure absence of contaminant or distorting matrix heterogeneities in order to assure the desirable optimal uniformity that would cause loss of signal due to light scattering.

Substantially unreactive small guest molecules include low molecular weight compounds which do not polymerize with the basic monomers or polymeric matrix. According to the present invention the small molecules do not form bonds under the matrix unit groups under the conditions prevailing during the gel formation, polymerization and post-polymerization treatment. Typically, the low molecular weight unreactive guest compounds are selected in accordance with the desired specific modification of the host matrix. Polymerization of monomers for the cladding layer of the present process is conducted in solution or suspension by radical initiation in the presence of a chain transfer agent at a temperature ranging approximately between 0° and 100° C.

The polymer matrix compound can be optionally produced by free radical polymerization in solution, in the presence of an initiator. Radically acting initiators which may be useful in the production of thermoplastic polymers for a step-index heterofiber or heterofilament are azo compounds such as azo-bis-isobutyronitrile, azo-bis-(cyclohexylcarbonitrile), azo-bis-(t-octane), 2-phenylazo-2, 4-dimethyl-4-methoxyvaleronitrile and organic peroxides such as t-butyl peroxide, t-butyl peroctanoate, t-butyl peroxyisopropylcarbonate, t-butyl hydroperoxide, t-butyl peroxyisobutyrate, and dicumyl peroxide. The applicable quantity of the initiator lies in the range from 0.001 to 3.0 moles, preferably 0.036 to 1.0 moles per 100 moles of monomer.

The polymerization may take place in the presence of a chain transfer medium (regulator or agent). Especially suitable for the vat or other mixing vessel production prior to extrusion of a step-index article or component thereof are mercaptans such as n-butyl or t-butyl mercaptan, propyl mercaptan, phenyl mercaptan, t-hexyl mercaptan and butylene-1,4-dithiol as well as esters of mercaptoacetic acid, e.g. methyl-mercaptoacetate, ethylene glycol-bis (mercaptoacetate).

The polymerization temperature may be in the range of 200° to 180° C., preferably 40° to 160° C., or more preferably 60° to 140° C.

It is recommended that the core mixture be degassed before polymerization. For this purpose the reaction mixture containing monomer, unreactive small molecule, one or more initiators and regulators is first cooled in a reactor to a temperature of at least −80° C., then the reactor is evacuated and warmed in the closed state to a temperature of 0° to 25° C. This process may be repeated several times. Alternatively, the reaction mixture of the core component of the heterofiber may undergo treatment with a stream of hydrogen, helium, argon or nitrogen gas which is passed down to the floor of the mixing vessel prior to injection into the hollow core of extruded filament through an immersed gas pipe for a period of about 1 min to about 60 min, preferably about 5 min to about 30 min.

Optionally, commercially available antioxidants and/or stabilizers may be added to the resin mixture in order to control filament uniformity and integrity.

The preferred shaped thermoplastic optical article is produced in the form of a heterocomponent article of a mass which is thermoplastically deformable. Such articles are useful in the shape of a bicomponent fiber, including transparent waveguides equipped with antistatic sensoring means or color coding.

The sheathed core filaments of this invention can be produced by the apparatus described in U.S. Pat. No. 5,256,050 which disclosure is incorporated herein by reference. This apparatus may be used for simultaneously spinning a plurality of sheathed core fibers or filaments using a spin pack assembly. Thus, a plurality of bicomponent fibers or filaments may be produced which contain a concentrically or eccentrically located core having a circular or elliptical cross section.

In addition, the spinning pack assembly may be readily adjusted to separately control and compensate changes in sheath polymer viscosity and flow to each spinneret core passage. The desired diameter of a multi-extended core filament is determined by the end portion of each passage which is tapered to a diameter ranging from 0.1 mm to 1.0 mm.

The coefficient of variability (CV) is defined as the percent standard deviation of fiber diameter of the mean fiber diameter. The deviation from roundness or circular cross-sectional shape can be monitored and corrected on the basis of the eccentricity coefficient of variability for simultaneously produced concentric bicomponent layers which preferably should be less than about 6% or, more preferably, less than about 1%. The eccentricity variability coefficient (ECV) is defined as percent displacement of the core center with respect to the bicomponent fiber diameter. The parameters for uniformity and concentricity are conceivably more exacting for optical fibers, in particular, the GRIN-type fiber, than for non-optical use, multicomponent thermoplastic filaments. It will be clear to the skilled artisan that the non-optical or multi-layer filaments may be meltspun at speeds higher than would be possible for a highly uniform optical wave-guide or signal fiber where precise shaping is essential.

Such dimensional or shape parameter can be automatically measured and controllably adjusted through a computerized system.

Thermoplastic bicomponent fibers may be shaped by ram extrusion using a motorized, gear controlled and heated cylinder and piston device. This apparatus is vertically positioned in order to insert the core in a downward direction from a spinning portion to a sheathing or enshrouding cladding portion of the apparatus allowing easier centering and feeding of the two main component layers. The required pressure and thermoplastic viscosity for spinning of the bicomponent fiber can be controlled by capillary rheometer.

Halogen-substituted or unsubstituted PMMA or another transparent thermoplastic matrix may be used for both core and cladding with the addition of at least one more active low molecular weight molecules to the core component. The appropriate conditions of pressure, heat and viscosity can be predetermined and selected by one skilled in the art.

Similarly, piston speed and pressure parameters are controlled and monitored at certain suitable points of the operation to balance extrusion rate against allowable shearing force and exit swelling. The required smooth surface aperture of the extrusion "jet" is preferably fabricated from very smoothly drilled teflon blades. The thermoregulation of the heater elements is closely monitored by elements set appropriately located in the extrusion head to ensure rapid heat transfer in close proximity to the exiting fiber product. In one embodiment according to the present invention, the temperature surrounding the thermoplastic product ranges from about 150° C. to about 300° C. during the extrusion and encladding operation. In the context of obtaining the desired post extrusion dimension of the fiber, one skilled in the art would know to adjust the relative extrusion velocities and concomitant drawing of the fiber or filament by the receiving spools.

Special care has to be taken to keep air and moisture from permeating into the thermoplastic material upon leaving the aperture. Water content may be diminished by pump evacuation and conventional chemical dehydration techniques which may be applied before entry into the extruder. In addition, there are several possible variables to take into account when operating a pressure extrusion mill. Friction will increase at the aperture as the heat applied to render the thermoplastic flowable also causes volume expansion of the thermoplastic core matrix. Concomitantly, high temperature has to be limited so as to prevent structural matrix degradation. In addition, destructive reactions with radical oxygen may be prevented or at least controlled by admixing soluble stabilizers and antioxidants to the polymer reaction mixture.

The molding material is injected or otherwise moved to the heating funnel device in the form of granulated or rod-type pre-polymerized plastic for the clad component. It may be desirable to feed the thermoplastic rods in a co-axial direction into the extruding piston/cylinder cavity.

Alternatively, this invention provides a method for shaping the fiber from a polymerized preform having conveniently shorter and thicker dimensions as, e.g., from about 5.0 mm to about 10 mm diameter. The preferred preform may be stretched or elongated at ratios of about 10:1 at about 250° C. or higher in a vertical heat-tube or cylinder then cooled to about 10°–15° C. and rolled up on a spool/roller. The heat-stretching obtains proportionally reduced fiber dimensions of about 1 mm or less.

It is recommended that, prior to heating and stretching of the preform rods, the preform rods are left under reduced pressure of $10^{-5}$–$10^{-1}$ mm Hg at 50° C. for 3–4 days in order to remove traces of volatile substances contained in the rods. The bicomponent spinning/polymerization method may also include a heat-shrinking step whereby bubble formation is suppressed. Typically a rod of less than one half meter in length is mounted in the heating cylinder or tube and allowed to descend very slowly at a velocity $V_1$ (mm/sec), so as to pass between heater elements which may concentrically rotate about the fiber axis for uniform irradiation at an appropriate temperature and drawn or stretched at a somewhat greater velocity by a drive roll situated vertically below the extrusion head and gathered onto an independently controlled storage spool. The applied heating temperature depends on the melting or softening range of the thermoplastic materials and is preferably chosen to be as low as possible or at about 200°–350° C.

In certain applications of fiber optics, e.g. coherent optical communications, integrated-optic devices, and optical sensors based on interferometric technology, an optical step-index fiber or GRIN fiber may be used to guide the complex amplitude by specifically polarized pulses of a certain magnitude and phase. One embodiment of the present invention provides polarization-maintaining step-index optical fibers or filaments. However, cylindrical optical fibers (of a circular cross section) tend to randomize the power division between the two polarization components which exist for each mode due to any slight imperfection or unavoidable strains in the fiber structure. For the special applications where this random power transfer is undesirable, an optical step-index fiber with concentric elliptical cross section would help eliminate the polarization degeneracy in that it deliberately introduces a phase mismatch and avoids the coupling efficiency of the conventional cylindrical fiber.

Another embodiment of a low cost bicomponent step-index optical or illuminating waveguide uses a basic polystyrene matrix as the glass-like transparent material. For the purpose of efficient internal reflection of light or wave signals, the index of refraction of the cladding component homopolymer matrix is lowered by admixing homogeneously 1–20% by weight of a small guest molecule suitable for decreasing the index of refraction. The fiber is produced by bicomponent spinning of polystyrene in the core and a cladding composed of polystyrene and a small, low refractive index molecule such as dibutyladipate.

One embodiment of the optical fiber of this invention utilizes fluorescent or phosphorescent additive molecules as described below which remain unreactive in the clad polymer matrix, providing a system for detecting and quantitating scattered or noisy light rays. The light energy lost in the cladding through scatter during transmission produces fluorescent energy blips or bursts that can be detected and counted or measured for intensity. The strength or intensity of the conducted signal which is received may be computer-adjusted for scatter loss to restore the clarity, sharpness and precision of the received output signal of a profile quality similar to the original input signal.

The luminescent compounds or pigments solubly contained in clad or sheath absorb visible or ultraviolet light and emit the absorbed photoenergy by fluorescence between states of equal multiplicity or by phosphorescence between spin-forbidden transitions. Suitable low molecular weight organic guest molecule of the host matrix can fluoresce for 0.1 to 10 nanoseconds or phosphoresce, that is emit the absorbed energy by decaying for a prolonged period. Phosphorescent pigments upon excitation by a visible or U.V. light ray emit a corresponding energy decay signal of longer wavelength lasting beyond the extinction of the excitation radiation or scatter signal (1 millisecond to 10 sec.). This property may be used to monitor and correct for the scatter of the light signal propagated through the core of multicomponent waveguide or optical fiber.

Suitable fluorescing compounds include organic fluorescing molecules such as fluorescing 4-Acetamido'-isothiocyanatostibene, 2,2'-disulfonic Acid, 7-Amino-4-methylcoumarin (AMC), 7-Amino-4-trifluoromethylcoumarin, N-(4-Anilino-1-naphthyl) maleimide, Dansyl chloride, 4',6-Diamidino-2-phenylindole (DAP), 5-(4,6-Dichlorotriazin-2-yl)aminofluorescein (DTAF), 4,4'-Diisothiocyanatostibene-2,2'-disulfonic Acid, Eiosin Isothiocyanate, Erythrosin B, Fluorescamine, Fluorescein and Derivatives, 4-Methylumbelliferone, o-Phthadlialdehyde, QFITC, Rhodamine B and Derivatives, Rhodamine 6G, Rhodamine 123, Sulforhodamine B, Sulforhodamine 101, Sulforhodamine 101 Acid Chloride, Tetramethylrhodamine Isothiocyanate (TRITC).

Another embodiment of the present invention is directed to a thermoplastic multicomponent device comprising a core component and a cladding component wherein the cladding polymer matrix is doped with a low molecular weight additive modifying the electromagnetic conductive property of the device. Such a semiconductive device may have the shape of a cylindrical fiber or filament comprising a core component and at least one cladding component.

Other embodiments of the bicomponent heterofiber or heterofilament of this invention contain at least one modified cladding layer wherein the small moleculer weight additive will effect the desirable properties in context with the specific function of the fiber or filament. For example, the cladding layer may be endowed in this way with advantageous insulating, adhesive, colorant or protective properties. Protective properties would include those with antiabrasive or antistatic effects.

Unreactive guest molecules may be added for clad modifications that enhance side-by-side bundling of the filaments or fibers. Such additives would modify adhesion, heat conductance, and effect color coding as well as coded orientation of the filaments or bundles thereof. Furthermore, clad modifications of this invention provide slidability and prevent electrostatic charge build-ups by the addition of antistatic agents and lubricants.

A problem in the use and production of plastic articles such as those of this invention is in the tendency to build up static electricity. This surface phenomenon is often due to friction which may be generated during extrusion or drawing of the filaments or fibers and further downstream during the processing of the filaments or fibers. Static charge can endanger circuitry or machinery by spark discharge or even explosions of volatile or flammable environments. Charge equilibration by antistatic agents may often be insufficient since it may require the reduction of volume resistivity by incorporating conductive fillers. A low molecular weight nonpolymerizing guest molecule in the thermoplastic host matrix may be useful as such an antistatic means. In such an embodiment the guest molecule is a cationic, anionic, and nonionic compound such as, e.g. a quaternary ammonia derivative of unpolymerized additives. Anionic compounds such as, e.g., sodium alkyl sulfonates at 1–7% by weight are particularly useful for modifying a homopolystyrene matrix. Non-ionic antistatic agents of this invention include ethoxylates of fatty amine, fatty acid ester, unreactive polyethelenic glycol ester, ether, and mono or di-glycerides. The amount of nonionic agents may range from 0.05 to 2.5% by weight.

In addition, internal antistatic agents act simultaneously as slip agents by lowering friction thereby easing, for example, the extrusion operation and downstream processing and handling. During polymerization of the base homopolymer matrix, the compatible, soluble guest molecule may favor the clad surface depending on the polymerization parameters of heating, cooling, and drawing. Other factors affecting the distribution of the additives are the homopolymer matrix, its density, and/or crystallinity. Asymmetrically charged antistatic agents which are not completely compatible may diffuse in the matrix and orient themselves toward interaction with the hydrophilic groups near or at the surface and with their uncharged nonionic, usually aliphatic, portion buried inside the polymer matrix. The initially uniformly distributed guest molecules are increasingly exposed at the surface which may undergo degeneration or stripping during the melt spinning thereby increasing the filament surface area.

The resistance of the plastic cladding surface may be lowered from about $10^{14}$ ohm to about $10^{9}$ ohm by the incorporation of internal antistatic agents in the polymeric host matrix. The static decay of the articles can also be tested for static decay according to the Federal Test Method Standard 101C Method 4046. Another test measuring chargeability includes rubbing the plastic surface with a cloth, exposing the surface to soot and observing the resulting attraction of the soot particles to the charged plastic surface (soot chamber test).

Color can serve as an important identifying aspect of the fibers of this invention. Preferred are dyes in the form of soluble and unreactive low molecular weight guest molecules. Temperature sensitive colorants may also be used to indicate fiber temperature fluctuations. The preferred dyes include organic compounds, e.g., of the quinacridine, disazo, azo condensation, monoazo, naphthol, and perylene type. Dry color blends or paste color dispersions may also be useful additive molecules, as long as they are compatible or soluble in the unpolymerized thermoplastic matrix. Soluble colorants providing color uniformity and nuances may be added to cladding matrix at concentrations ranging from 10% to 60% by weight.

In accordance with this invention, nonoptical filaments may be produced wherein the guest molecules modify cladding properties in terms of flexibility, flow, wettability and bonding so as to effect the final product utility or shape.

The translucent polymer matrix of the shaped optical articles according to the present invention is preferably processed from fluorinated polymers. Fluorinated plastic or elastomeric compounds are particularly suited as polymer optical transmitters since their attenuation is favorably low at wavelengths of about 700 nm, i.e. in the visible spectrum. Moreover, the light transmission of fluorinated polymer optic waveguides is clearly improved over the state of the art optic waveguides containing polymers derived from monomer units which for the most part contain hydrogen atoms. The optic waveguides or fibers manufactured from these fluorinated polymers can also be used in the wavelength range of 850 nm in which high performance luminous diodes and semiconductor lasers as well as receivers are available so that long transmission distances of light signals are possible.

Fluorinated polymers are useful in the present invention as a transparent polymer matrix must have a high glass transition point and high light transmittance. Fluorinated polymers as described below are preferably used which display higher transparency than polymethylmethacrylate (PMMA), a thermoplastic polymer frequently used in the art for the manufacture of optical fibers.

The initial material for the synthesis of the fluorine-containing polymer may be a compound of formula I:

$$\mathrm{CFX{=}CF{-}\underset{\underset{O}{\|}}{C}{-}OR} \qquad \text{(I)}$$

wherein X is a hydrogen atom or a deuterium atom, and R is a linear, branched or cyclic $C_1$–$C_{10}$ alkyl group or a $C_6$–$C_{10}$ aryl group. The hydrogen atoms of R may be completely or partially replaced by fluorine, chlorine, or bromine atoms.

The acid component of the esters, according to the preferred embodiment consists of 2,3-difluoroacrylic acid or 3-deutero-2,3-difluoroacrylic acid.

The alcohol component is preferably methanol, a fluorine or chlorine-containing linear or branched or alicyclic alcohol with 2 to 10 carbon atoms or an aromatic alcohol with 6 to 10 carbon atoms. More preferred components are methanol, chlorine and fluorine containing linear or branched, or alicyclic alcohols with 3 to 10 carbon atoms as well as phenols and benzyl alcohol. Especially preferred are methanol, hexafluoroisopropanol and 2-deuterohexafluoroisopropanol, alkyl and aryl substituted hexafluoroisopropanols such as perfluoro-2,3-dimethyl-2-butanol, 2-pentafluorophenylhexafluoroisopropanol and 2-(p-fluorophenyl)hexafluoroisopropanol, fluorine-and chlorine-containing cyclopentanols and cyclohexanols as well as 1,4,5,6,7,7-hexachloro- and hexabromobicycloheptenol, 1,4,5,6,7-pentachloro- and 1,4,5,6-tetrachlorobicycloheptenol, 5,5,6,6-tetrakis (trifluoromethyl)bicycloheptanol, 5,6-difluoro-5,6,-(trifluoromethyl)bicycloheptanol, 5,5,6,6-tetrafluorobicycloheptanol, 1,4,5,5(or 6,6),7,8-hexachloro-6(or -5)oxobicyclooctenol or (1,4,5,6,7,7-hexachlorobicycloheptenyl)methanol and their deuterated derivatives, as well as pentafluoro, pentachloro- and pentabromophenol.

Among the esters are those especially preferred groups wherein the hydrogen atoms of the alcohol in the acid component are replaced as completely as possible by deuterium, fluorine, chlorine or bromine atoms. More preferred esters are methanol-$d_3$, 2-deuterohexafluoroisopropanol, trichloroethanol-$d_2$, 3-pentafluorophenyl-hexafluoroisopropanol, perfluoro-2,3-dimethyl-2-butanol, perfluoro- or perchlorocyclopentanol or cyclohexanol as well as 1,4,5,6,7,7-hexachloro and -hexabromobicycloheptenol-$d_3$, 5,6-difluoro-5,6-bis (trifluoromethyl)bicycloheptanol-$d_{11}$, 5,5,6,6-tetrakis (trifluoromethyl)bicycloheptanol-$d_{11}$, 5,5,6,6,-tetrafluorobicycloheptanol-$d_{11}$, 1,4,5,5(or 6,6),7,8-hexachloro-6(or-5)oxobicyclooctenol-$d_3$, or (1,4,5,6,7,7-hexachlorobicycloheptenyl)methanol-$d_5$, pentafluorophenol or pentachlorophenol.

The hydrogen atom in the acid component, and possibly the hydrogen atom or atoms in the alcohol component is preferably replaced by one or more deuterium or fluorine atoms since the hydrogen atoms may impair the transparency of the polymers in the useful visible and in the near-infrared region of the electromagnetic spectrum.

The 2,3-difluoroacrylic acid esters according to Formula I may be synthesized by esterification of 2,3-dichloro-2,3-difluoropropionic acid or a corresponding acid halide with an alcohol of the formula R-OH, where R has the meaning given in formula I, and subsequent dehalogenation with zinc. The corresponding 3-deutero-2,3-difluoroacrylic acid esters are obtained by esterification of the 3-deutero-2,3-difluoroacrylic acid or its acid halide with an alcohol as described above.

A preferred embodiment according to the present inventive process provides a polymer matrix of the shaped articles which are produced from units derived from one or more esters of formula II:

$$\mathrm{CYY'{=}CX{-}\underset{\underset{O}{\|}}{C}{-}OR} \qquad \text{(II)}$$

where X denotes a hydrogen or a deuterium atom, $C_1$–$C_6$ alkyl, preferably methyl, or a fluorine atom; Y denotes a hydrogen or a deuterium atom; Y' denotes a hydrogen or a deuterium atom; and R is a linear, branched or cyclic $C_1$–$C_{10}$ alkyl group. The hydrogen atoms in X, when X is $C_1$–$C_6$ alkyl, or R may be totally or partially replaced by fluorine atoms.

Other suitable fluorinated polymers for the process of the present invention are polymeric 2-fluoroacrylic acid esters, especially esters of aliphatic alcohols. These polymeric materials may contain deuterium atoms both in the alcohol and also in the β position of the 2-fluoroacrylic acid component (see EP 128517). These polymers have indices of refraction between 1.45 and 1.60 and glass transition points between 100° and 200° C. and thus may serve as the polymer matrix material for optic waveguides or optic fibers. Polymeric 2-fluoroacrylic acid esters of bromine, chlorine, fluorine or deuterium containing alcohols may also be used.

Suitable polymers are obtained essentially from 2-fluoroacrylic acid methyl esters, from 2-fluoro- and 2,3-difluoroacrylic acid esters, methacrylic acid esters and acrylic acid esters, of the alcohol component as described above.

The preferred polymers for producing GRIN fibers according to present process useful for the continuous manufacture of optical fibers are poly(trifluoroethyl-2 fluoroacrylate) ("poly 3FFA"); poly-(trifluoroethyl methacrylate) ("poly 3FMA"); and poly-(2-fluoroacrylic, hexafluoroisopropyl acid) ("poly HFIP2FA"). Poly 3FMA and poly HFIP2FA are soluble in their monomers as is desirable for the present process and thus useful in continuous production of fibers. The especially preferred 2-fluoroacrylic acid monomer in cladding and core is 2-fluoroacrylic acid hexafluoroisopropyl ester ("HFIP2FA").

Substantially unreactive small guest molecules are understood to include low molecular weight compounds which do not polymerize with the basic monomers or polymeric matrix. It is presumed that during the continuous operation of the process according to the present invention the small molecules do not react radically within the condition parameters prevailing during the gel formation, polymerization and post-polymerization treatment. Typically, the low molecular weight guest compounds are selected from certain high refraction index aliphatics or alkylaromatics, which may be optionally substituted with, e.g., halogen atoms and preferably fluorine atoms. The guest molecule, of course, must be selected so that it is optically compatible with the particular polymer system of the shaped article.

Small molecules suitable for the core layer of the present invention process may be selected from, but not limited to, the group of dibutyl phthalate, benzyl benzoate, butyl phenyl phthalate, benzyl-n-butylphthalate, 1-methoxyphenyl-1 phenyl ethane, 3-phenyl-1-propanol, bromobenzene, m-dichlorobenzene, 1,2-dibromoethane, o-dichlorobenzene, bis(1,1,1,3,3,3 α-hexafluoroisopropyl)terephthalate, and other halogenated or, preferably, fluorinated aromatics.

In an embodiment of the process according to the present invention, the small guest molecule is a molecule of the formula III:

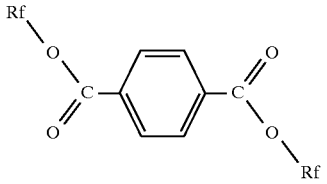

(III)

wherein Rf is $C_1$–$C_{10}$ alkyl, $C_6$–$C_{10}$ aryl or a partially or fully halogenated $C_1$–$C_{10}$ alkyl or $C_6$–$C_{10}$ aryl group.

The production and properties of the thermoplastic polymers poly-(2-fluoroacrylic acid fluoroalkyl esters) are known in the art (see EP 128516). Polymerization of monomers for the cladding layer of the present process is conducted in solution or suspension by radical initiation in the presence of a chain transfer agent at a temperature approximately between 0° and 100° C.

The continuous process of the invention suitable for the heat-stretch production of a single-mode or multimode plastic optical fiber may also be applied to several geometric shapes, such as e.g., multilayer slab-type transmitter or receiver with a GRIN core having a refractive index which gradually decreases radially from a relatively high refractive index value at the central plane of the slab core to a minimal refractive index value at the peripheral region and is thus designated as a convex lens-type optical transmitter. This type of light transmitter is preferably used to economically manufacture a bar-type lens of great uniformity between at least two cladding layers.

In an embodiment of the present invention a bicomponent optical fiber having a graded index core may be produced in a continuous operation. First, a thermoplastic molding resin composition which has been previously prepared according to usual methods is heated to pliable softness and shaped by extrusion through a conventional motorized piston or gas pressurized extruding device form a cylindrical cladding or tubing structure which is preferably in a vertical position. The thermoplastic composition of the cladding is preferably a polymer which has the desirable characteristics of relatively low refractivity and high signal transparency.

Extrusion of thermoplastic polymer cladding requires special care to avoid scoring and other surface blemishes, particularly on the inside of the tube as well as uneven thickness. The aperture edges of the extruder should therefore be precisely machined and polished to a completely smooth contact surface. Moreover, the polymer mass must be homogeneous and free of contaminants such as dust, lumps and other materials expected to interfere with a uniform, flawless extrusion process. Preferred nozzle or disk extruder material includes e.g. polished stainless steel, plastic laminated steel, and teflon.

A suitable monomeric core admixture is pressure injected or gravity fed into the hollow core portion enveloped by the cladding structure, from a nozzle cone located at the center of the extrusion device which is generating the polymeric cladding or tubing. The mixture comprises the appropriate monomeric substance and an effective amount of a compound which is preferably of low molecular weight and soluble in the monomer and unreactive in the polymer and has relatively higher refraction index. The core portion, which comprises the same polymer as the cladding, is polymerized within the cladding tube, for example, by applying radiation from the outside of the cladding tube in a uniform fashion so that the core mixture is gradually polymerized from the periphery towards the center of the core.

Another preferred embodiment provides for the use of a vertical fiber drawing tower as part of the polymerization process in order to avoid bubble formation and entrapment. In this embodiment, the extruded cladding containing the unpolymerized core mixture is drawn between a pair of oppositely located drive-rollers by stretching under sufficient heat to render the thermoplastic cladding polymer deformable while polymerizing the core reaction mixture.

Thus, the core portion is polymerized while the cladding is simultaneously heat-stretched to prevent vacuum void or bubble formation. Subsequent to the completion of the core polymerization phase, the heterofiber is drawn into the size and shape of the final product by means of a second stage drawing tower which is preferably in a vertical position. The finished product is rolled onto a receiving spool, barrel, or wheel.

An electronic, optionally computerized, monitoring system is utilized in order to continuously control and adjust all the various conditions of the process. The parameters which may be controlled by the monitoring system include the temperature of the extrusion nozzle or disk, the pressure of extrusion, the filling rate of the core mixture, the radiation energy, the rotation velocity of the radiation lamp cluster (U.V. or I.R.), the heating temperature and the intermittent pulling for the antivoid control, and the tension and temperature of the polymerized preform, and the elongation or drawing of the final fiber or filament product.

Referring to FIG. 1 for a schematic of continuous production of bicomponent fiber, a premanufactured or polymerized thermoplastic (i.e. PMMA) tubing 1 (preferably at least about 100 m in length) is stored on a cylindrical roll or spool 3. The proximal receiving end of the tubing is connected through a suitable extension 4 to a reaction vessel 5 containing a core filling mixture of at least one kind of monomer (i.e. MMA), a catalyst, a chain transfer agent and a small non-polymerizable, soluble guest compound of low molecular weight. The core filling reaction mixture is fed by gravity or under pressure from the vessel 5 through the filler tubing at the center portion of the spool 3 into the preclad tubing 1 until completely full. The core reaction mixture is maintained at a constant (full) level inside the preclad tubing 1 and moved continuously at an adequate pace through a polymerization and drawing apparatus 6 preferably at a vertical position.

Inside the polymerization portion 6A of the cylinder, the core mixture is irradiated either by an ultraviolet lamp cluster 10 or an infrared heat lamp cluster 10*a* that can be rotated about the cylinder axis 11. The rotational axis is concentrically oriented with the fiber core axis 7. During polymerization or immediately upon onset of same, the tube/cladding is heat stretched to prevent vacuum voids or bubbles in the core. Pulling using motorized rollers 14 and heating mechanism 15 extends approximately from the entry into the polymerization compartment 6A to the end of the heat source. For uniformity of heating the mechanism 15 involves a rotatory cluster of infrared lamps or other heat producing elements. Immediately after the core filled tubing passes through the polymerization compartment 6A, it is heated and stretched or drawn to an optical waveguide 7, maintaining the overall proportion of the core and cladding layers. Once the final dimensions i.e. final diameter have been formed, the polymerized waveguide or optical fiber 7 is cooled to a range of about 5° to 15° C. and rolled up on a receiving spool for storage. For monitoring the suitable uniform diameter and roundness dimensions of the stretched article at least one gauging device is located within the stretching chamber before the cooling step is applied to the continuously moving optical waveguide or fiber 7.

Figure 2:
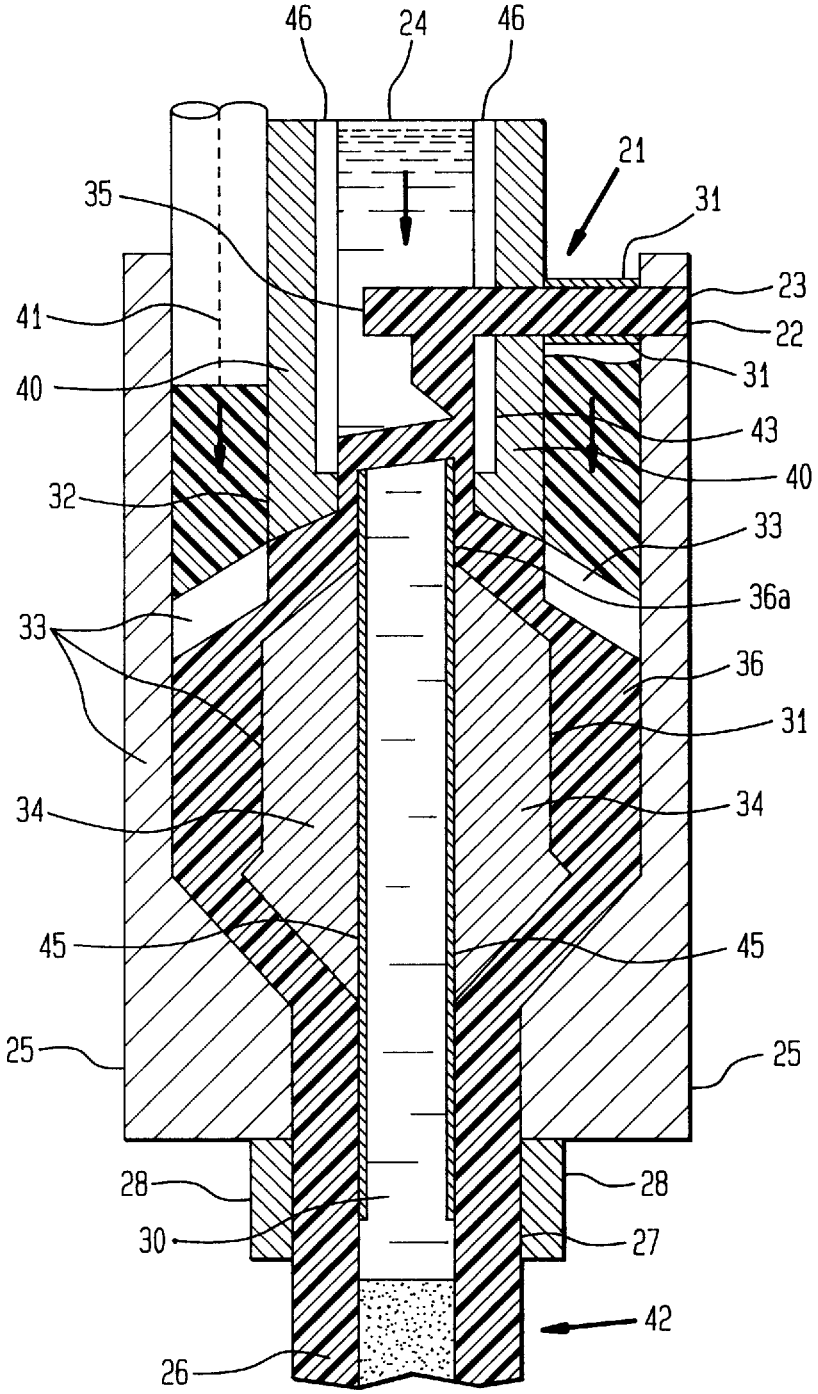
FIG. 2 illustrates a layout for the production of GRIN fiber by co-extrusion of PMMA tube with liquid core.

The particular embodiment according to FIG. 2, pertains to a bicomponent extrusion process whereby the GRIN-heterofiber is produced by combined extrusion of the polymeric core and cladding. In this coextrusion process the clad tubing is polymerized while the core reaction mixture which fills the cladding enclosed space is still liquid or only in soft pre-polymerization gel form.

In this embodiment of the invention a ram-extruder fills the cooled unpolymerized core mixture in monomeric or gel form into the clad tubing which is shaped by means of a heated die (see FIG. 2). The temperature of the die body 25 is heated sufficiently to over about 200° C., to melt the thermoplastic polymeric material as it is pushed under pressure from a tubular ramming device 41 into the shape of clad tubing 26 exiting between the injection nozzle or ram jet 27 portion. Upon exiting the tubular nozzle portion 28, the formed clad polymer tube is immediately cooled in a waterbath to about 4° C.–25° C. while the core reaction mixture 24 is filling the core portion of the clad tubing 26 through the central nozzle 30. As a more preferred feature of the ram extruder 21, the inner channel guide 22 is optionally cooled to protect the liquid core material 24 from the hot clad polymer 23. The liquid core mixture 24 is optionally composed so as to permit subsequent irradiation polymerization within the clad tubing in an irradiating cylinder 42 using a rotatory ultraviolet or infrared lamp cluster for uniform energy supply or input.

The preferred continuous ram extruder as illustrated in FIG. 2 in a cross-sectional drawing shows soft-melted clad polymer 23 entering under pressure-delivery the apparatus 21 at the end point of the forked section 35 from the melt entrance guide 22 through the opening 43 into the heated fore-chamber 36*a*. The melt softened polymer 23 flows at suitable viscosity between mandrel 34 and sleeve 40 into the accumulating chamber or space (enclosed by mandrel and die body) 36 from which it is squeezed by the preferred tubular groove ram having a flexible end through a suitably tight circular opening surrounding the central core filling nozzle. The central core filling nozzle 30 is provided to access the liquid or gelled core mixture and fill the same into the clad tube at a suitable solidifying temperature such as, e.g., from 4° to 20° C. The central nozzle 30 is arranged at the end portion of the apparatus 21 extending from the water cooled or refrigerated filling tube or tubing into which the core mixture is fed using either gravity or a pumping force. The pumping force may optionally be in the form of a peristaltic pump. The core mixture is protected from the heat of the mandrel and cladding polymer by an insulating sheath 45 and cooled air space 46.

For best control, the sheath, mandrel and die body are heated at various points on areas 33 to a range of about 200° C. to about 270° C. in order to effect an appropriate viscosity and flow of the thermoplastic clad polymer as it is shaped as a preform clad. For optimal control of uniform flow behavior, the ram extruder is also heated. In addition, the temperature is tightly or precisely controlled in order to minimize breakdown of the clad polymer.

The surfaces of the ram jet nozzle producing the cladding preferably are intended to be highly uniform and free of grooves or similar flaws. A capillary rheometer is used to monitor the viscosity condition of the melt-softened clad polymer near the entrance 22 in the accumulator 36 and at the exit jet portion 26. The shearing velocities are also monitored to control the behavior of the pre-clad polymer. Multiple heating zones are arranged along the pathway of the pre-clad polymer to be adjusted or used independently. All heat monitoring instrumentation is in the closest possible proximity with the polymer material for accurate measurement.

Preferably, the ram extruding tube 41 rotates slightly during the compressing or ramming motion counter to the rotation of the adjustable mandrel 34. The rotation rate of either component is optional.

The pre-clad polymer may be prepared by melting and mixing granulated resin under a pre-chamber vacuum to remove the trapped air void (not illustrated). The melted viscous polymer material then is kept pliant or soft while it is pushed or squeezed into the opening of the melt flow receptor of the apparatus 21 from where it is guided into the accumulator 36 for ram extrusion.

Figure 3:
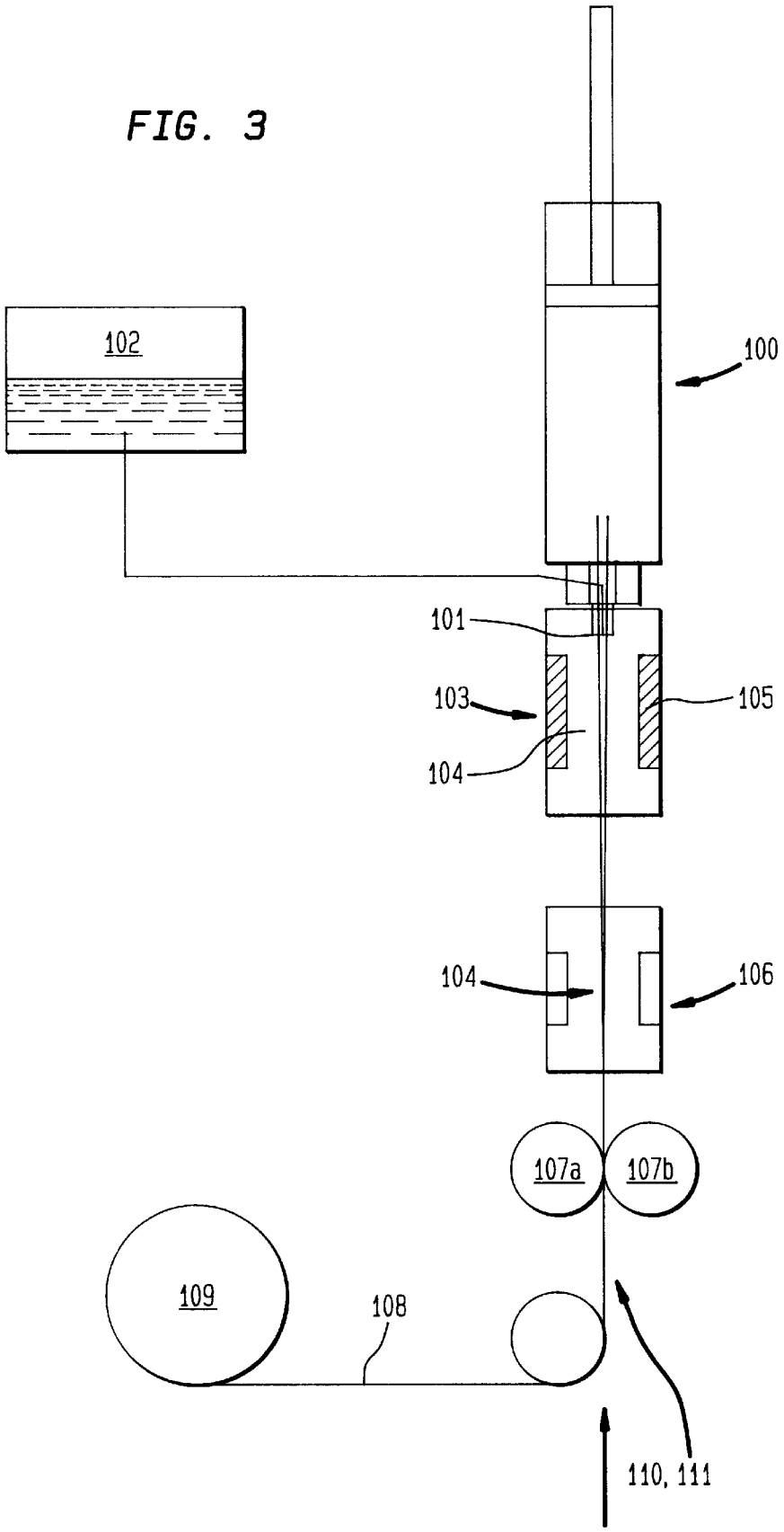
FIG. 3 illustrates various stages of the continuous GRIN fiber production process.

Another embodiment of the present invention as illustrated in FIG. 3 provides a continuous process in a vertically arranged apparatus 100 producing a transparent cladding or tube comprising a thermoplastic polymer which exhibits the desirable characteristics of low refractive index and high transparency. The thermoplastic cladding polymer is heat-shaped by pressure extrusion into hollow tubing 101 which is simultaneously filled with the fluid admixture 102 of monomeric material compatible or identical with the monomeric base repeat unit of the cladding polymer. The monomeric core admixture 102 also contains at least one soluble small guest compound, a catalyst, and a chain transfer agent. The additive compound is intended to be a soluble but substantially unreactive low molecular weight molecule further characterized by a relatively high index of refraction of about 1.4 to 1.5. Upon polymerization of the monomeric material, the core portion will contain a continuous concentration gradient of the additive compound which increases toward the center axis as described above. The core refractive index is thus highest at the core center axis while gradually decreasing to its lowest value at the core-cladding boundary.

The thermoplastic low attenuating cladding polymer which is preferably a halogenated homopolymer or more preferably a fluorinated homopolymer, is slightly soluble in the core mixture containing the still unreacted fluorinated base monomer. The core monomer and other ingredients such as low molecular weight additives may diffuse into the inside wall matrix of the cladding polymer, at least partially expanding or dissolving the cladding matrix into a soft gel before polymerization takes effect.

The core polymerization step is initiated in the radiation chamber 103 from a suitable energy source at the periphery of the cladding wall 104 and proceeds towards the core center axis. During polymerization, the cladding 104 is externally heated in the heating compartment adjacent or contiguous with the radiation chamber 105. At a suitable point, this preformed bicomponent fiber or column is stretched or drawn by means of a drawing tower arrangement 106 pulling with a pair of oppositely positioned squeegee wheels 107*a*, 107*b* in the direction of the long axis with a sufficient force in order to shape the dimensions of core and cladding as desired in the final product 108. Due to the uniformity and identity of the base polymer, the bicomponent fiber consequently polymerizes into a monolithic-type article. The drawn and finished fiber is immediately air cooled to room temperature and then rolled onto a spool 109 for storage.

The continuous process is particularly suited to the radical polymerization of a core polymer matrix. Radical polymerization is initiated by the free radicals produced from a radical polymerization initiator present in the solution and driven by the irradiation energy supplied by a suitable U.V. light 105 (or by heat from an I.R. lamp) located near the periphery of the reaction chamber 103.

One or more U.V. (or I.R.) lamps may be utilized 105 for rotating in a cluster around the outside of the cladding 104 effecting uniform and rapid polymerization of the core matrix 102. The center of rotation of the lamps is intended to be concentric with the center axis 110 of the fiber 111 (arrow).

The thermoplastic cladding polymer composition, may be first heat softened and extruded in the form of a tubing. The same tubing's core cavity is then filled with the fluid monomeric core composition. Similar to the continuous process illustrated in FIG. 1, the filled core is then polymerized either by heat or suitable light, depending on the components of the mixture, and stretched to avoid bubble formation. After polymerization, the cladding/core assembly is drawn or elongated under continued adequate heat to the final bicomponent fiber product dimensions.

The entire final fiber product 108 is rolled up or gathered on a receiving spool 109. The rate of rotation of the spool is kept such that there remains a slack in the fiber as it exits from the drawing tower 106. The final fiber 108 will exhibit, regardless of its length, a graded refractive index that is essentially uniform along the entire optical axis.

Figure 4:
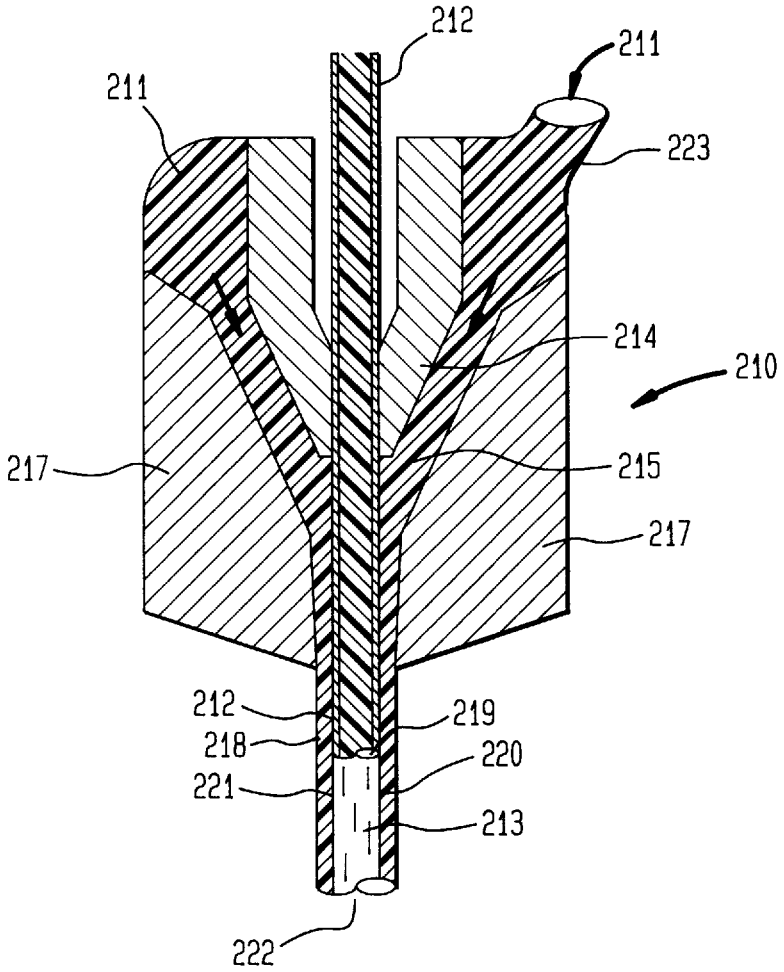
FIG. 4 illustrates the extrusion device for producing step type thermoplastic sheathed or cladded fibers or filaments.

An extrusion apparatus 210 in FIG. 4, depicts part of the extrusion and drawing system for producing a step-index optical fiber 211 in accordance with the present invention. The core mixture or pre-gelled core mixture is under constant agitation and partial vacuum of about 0.1 atm. Alternatively, the mixed polymer can be prepared in a closed vat (not shown) under an inert gas such as, e.g., argon. The cross-linking of the core matrix is energized either by heat or ultraviolet radiation, heat being the preferred energy source. The temperature may range from about 150° to about 400° C., more preferably from about 180° to about 200° C.

The soft melt-heated core polymer is fed by gravity or pump action to the system apparatus that is preferably vertically maintained as shown. More particularly in FIG. 4, the core polymer flows through a central extrusion tube 212 toward the coextrusion nozzle 213 of the ram extrusion apparatus 210. The central extrusion tube is located in the center portion of a round, cone like mandrell 214 that provides a funnel space 215 between its outside surface 216 and the diebody 217 of the apparatus 210.

The cladding thermoplastic resin 211 is prepared in a separate vat (not shown). The melt softened polymer preparation is directed through special tubing or pipe 223 into the funnel space 215 of the extrusion apparatus 210. Applying a ram-tube for forcing the cladding material toward and through the funnel space 215 and finally the outside extrusion nozzle 218. As the clad tube is pushed beyond the core nozzle edge 219 it encloses and anneals directly 220 on to the core fiber column 221 emanating from the central core nozzle tip 213. Immediately after this coextrusion event, the encladded core fiber is stabilized by passage through an appropriately cooled waterbath which is at a temperature between 4° to 20° C.

This preform 222 can be further shaped into thin, filamentous form by the heating and drawing process using heating elements and drawing wheels. The finished continuous product is gathered, wound-up on a spool or wheel (not shown).

Whereas this method of the invention is usually applied to cylindrical fibers (i.e. with circular cross section) other shapes, e.g., elliptical or angular may be produced depending on the need and area of application as further discussed below. Moreover, a cylindrical filament may be formed from a core and clad having each hemispheric cross section outline.

Another embodiment of the invention is illustrated by the following: A thermoplastic mass or block of transparent polymer materials such as e.g. PMMA is melted with a cylindrical heating element at about 200° C. into a soft deformable state in a heated container device connected to a motorized ram or disk extruder which is equipped with a center hollow needle-like nozzle. The PMMA is squeezed through the extruder to form a tubing-like cylindrical cladding component. Concomitantly, the hollow space of the cladding is filled by injection from the centrally situated infection nozzle of sufficient width and length with e.g. a mixture of MMA monomer, additive/solvent (bromobenzene), catalyst and chain elongating agent.

The monomer penetrates into the inside surface of the PMMA tube partially solubilizing it before polymerization onset as the bulk solvent (bromobenzene) concentration is gradually increased by displacement toward the center axis of the tube.

While simultaneously polymerizing the GRIN core filling, the surrounding cladding or tubing is softened for drawing with peripheral uniform heat (rotating lamp cluster) so that the pulling tension is applied by a receiving wheel from which the finished fiber was spooled on to a suitable spool for storage.

The GRIN filament may be further modified so as to protect it from chemical corrosion by application of a sheath or coating containing ingredients importing the desired effect such as, e.g., PTFE or varieties thereof. Other desirable properties may be afforded by adhesive, lubricant, colorant, decoration or identifying patterns or design—so as to aid in the use and organization of individual classes of filaments.

What is claimed is:

1. A multi layer thermoplastic article comprising a core layer and a cladding layer, each layer comprising a high molecular weight polymeric matrix, and wherein only one of the cladding layers further comprises one of a variety of low molecular weight guest compounds substantially unreactive with the polymer matrix but soluble therein and each of which compounds attributes a specific property to the cladding cladding layer so as to differ in terms of that property from the other layer.

2. The article of claim 1 wherein the core layer and the cladding layer are concentrically annealed in the form of cylinder.

3. The article of claim 1 wherein the cladding layer comprising the guest compound exhibits modified physical or chemical properties.

4. The article of claim 3 wherein the properties exhibit an antistatic capacity.

5. The article of claim 3 wherein the properties phosphoresce or fluoresce at a point where a light ray scatters from the core layer into the cladding layer containing the compound.

6. The article of claim 5, wherein the light scatter is monitored by fluorescent or phophorescent bursts of energy.

7. The article of claim 3, wherein the properties are a color or tint for identification.

8. The article of claim 1, wherein the low molecular weight guest compound is uniformly distributed in a layers at a concentration of about 1%–20% by weight of the layer.

9. The article of claim 1, wherein one cladding layer contains the low molecular weight guest compound which effects an adhesive, insulative, anti-abrasive, or lubricant property.

10. The article of claim 1, further comprising a sheath layer provided with a color codifying property.

11. The article of claim 1, wherein the guest compound is distributed in a continuous gradient.

12. The article of claim 1, wherein the guest compound effects light filtration.

* * * * *